United States Patent [19]

Davis, Jr. et al.

[11] Patent Number: 4,534,165

[45] Date of Patent: Aug. 13, 1985

[54] CATALYTIC COMBUSTION SYSTEM

[75] Inventors: L. Berkley Davis, Jr., Schenectady; Milton B. Hilt, Sloansville; Colin Wilkes, Scotia, all of N.Y.

[73] Assignee: General Electric Co., Schenectady, N.Y.

[21] Appl. No.: 540,036

[22] Filed: Oct. 7, 1983

Related U.S. Application Data

[63] Continuation of Ser. No. 479,918, Mar. 28, 1983, abandoned, which is a continuation of Ser. No. 181,966, Aug. 28, 1980, abandoned.

[51] Int. Cl.[3] ..... F02C 3/16

[52] U.S. Cl. ..... 60/39.02; 60/723; 60/746

[58] Field of Search ..... 60/723, 746, 39.822, 60/39.826, 39.02; 431/7, 284, 285, 328

[56] References Cited

U.S. PATENT DOCUMENTS

| | | | |
|---|---|---|---|
| 3,797,231 | 3/1974 | McLean | 60/723 |
| 3,938,326 | 2/1976 | DeCorso et al. | 60/723 |
| 3,943,705 | 3/1976 | DeCorso et al. | 60/737 |
| 4,047,877 | 9/1977 | Flanagan | 60/723 |
| 4,054,407 | 10/1977 | Carrubba et al. | 60/723 |
| 4,072,007 | 2/1978 | Sanday | 60/723 |
| 4,197,701 | 4/1980 | Boyum | 431/7 |

*Primary Examiner*—Carlton R. Croyle
*Assistant Examiner*—Jeffrey A. Simenauer
*Attorney, Agent, or Firm*—J. C. Squillaro

[57] ABSTRACT

A catalytic combustor comprises a pilot zone having means to introduce fuel therein; upstream of said pilot zone and communicating therewith a catalytically supported thermal combustion zone comprising a plurality of catalytically supported thermal combustion sections each comprising a solid oxidation catalyst, means for introducing air into said section and means to introduce fuel into said section; and means to control the rate of fuel flow in each of the means to introduce fuel into a catalytically supported thermal combustion section and the means to introduce fuel into the pilot zone. The combustor is operated by staging the fuel supply in order to maximize the amount of combustion in the catalytically supported thermal combustion zone and minimize NOx emissions under all load conditions.

3 Claims, 1 Drawing Figure

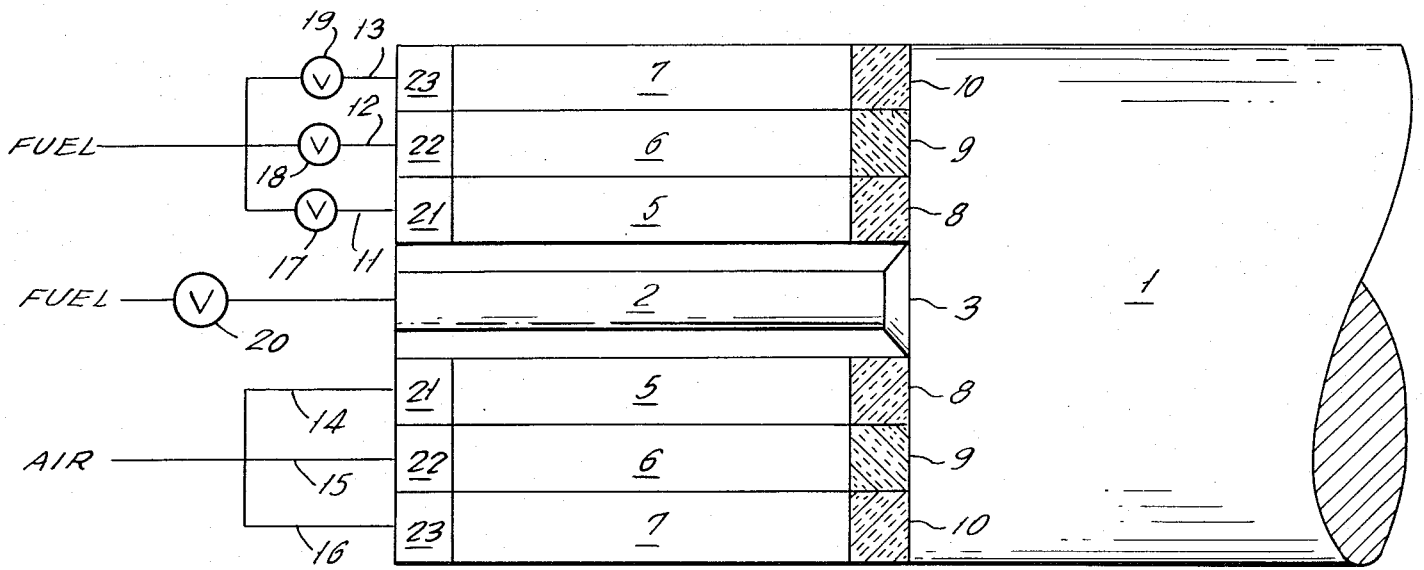
1
10
9
8
3
8
9
10
7
6
5
2
5
6
7
23
22
21
21
22
23
13
12
11
19
18
17
20
14
15
16
FUEL
FUEL
AIR

CATALYTIC COMBUSTION SYSTEM

This is a continuation of application Ser. No. 479,918, filed on Mar. 28, 1983, of L. Berkley Davis, Milton B. Hilt, and Colin Wilkes, for CATALYTIC COMBUSTION SYSTEM, now abandoned, which is a continuation of application Ser. No. 181,966, filed on Aug. 28, 1980, now abandoned.

BACKGROUND OF THE INVENTION

Various methods for the thermal reaction of carbonaceous fuels for powering conventional engines and power plants are known. One system which has been used in connection with stationary gas turbines is a catalytic combustor system. These systems are based on a mechanism which has been called catalytically supported thermal combustion and the physical mechanisms that allow sustained catalytic combustion to occur at high reaction rates are discussed in detail in Pfefferle, U.S. Pat. No. 3,928,961.

Basically, the catalytically supported thermal combustion state is achieved when there is a sufficiently intense catalytic combustion adjacent to the walls of the chamber containing the catalyst to maintain a high bulk temperature and to thereby support thermal combustion in the free stream of the fuel-air admixture. If the temperature is not sufficiently high, thermal combustion will be incomplete and substantial quantities of the fuel will not be burned. Accordingly, the two design parameters for steady state operations of such a catalytic reactor are the mixture inlet temperature and the fuel-air ratio. The latter parameter controls the temperature rise in the reactor.

Tests which have been performed for the United States Environmental Protection Agency have identified the minimum preheating temperatures that are required for lean catalytic operations. When the fuel is natural gas, values of about 350° F. for noble metal catalysts and 300° F. for base metal oxide catalysts are typical. For liquid fuels such as No. 2 heating oil, values in the range of 300°-600° F. have been demonstrated. In typical gas turbine systems, the compressor discharge temperatures are in the neighborhood of 600° F. and therefore no additional preheating of the incoming air stream is necessary.

In general, the maximum operating temperature of a catalytic combustor is limited by material capabilities to below 3000° F. and the minimum temperature is generally limited by the combustion stability of the fuel-air system to above 1800° F. Since the current commercial stationary engines have turbine inlet temperatures of approximately 1850°-2000° F., they are well suited for use with catalytic combustors. During the steady state operation under load, the catalyst temperature is somewhat in excess of the turbine inlet temperature because of liner cooling and the dilution air which is added to the reactor combustion products. Operation at about 2300°-2400° F., in fact, provides a substantial degree of flexibility in the selection of appropriate catalyst systems. However, since inlet temperatures are well below 1800° F. in combustors during the start up sequence and during the loading sequence, and since air scheduling is not considered to be a desirable control technique, alternate means of start up are required.

It will be appreciated that the peak temperatures in the catalytic bed equals the adiabatic flame temperature of the entering fuel-air mixture. Accordingly, if the operating temperature is to be 2300°-2400° F., the maximum bed fuel-air ratio is limited.

The most efficient and stable combustion occurs in a catalytic reactor when the burning mixture is in contact with the catalyst for a sufficiently long period. When the contract period is too short, insufficient energy is generated adjacent to the catalyst surface to sustain combustion in the main or free stream. While a number of analytical models of this complex have been developed, two parameters in particular—face velocity and nominal residence time of the mixture in the reactor—have been used to evaluate experimental performance in actual use.

The maximum values of face velocity, i.e., the mean velocity of the mixture upstream of the catalyst, range from about 80-150 ft./sec. for various catalysts. This condition also requires that the catalytic reactor have a minimum frontal area for the combustor air-fuel flow to traverse.

The maximum acceptable face velocity is established by the given values of the catalyst operating temperature, pressure, stoichiometry and preheating temperature. Further increases in velocity result in blowouts. Lower limits on the velocity of the mixture are set by the mixture flame speeds in order to avoid flash-back and are determined by proper selection of the combustor cross-sectional area. The maximum achievable velocity depends on flow conditions and catalyst parameters such as type, monolith cell size, and web thickness. Use of noble metal catalysts with face velocities in excess of 100 ft./sec. and metal oxide catalysts in excess of 150 ft./sec. have been demonstrated.

The minimum residence time in the combustor is a function both of the face velocity and the reactor length. Since the velocity increases as the fuel burns and the temperature rises, the face velocity establishes a minimum velocity level just upstream of the catalyst bed.

The foregoing description has been concerned with a catalytic combustor operating at or near its design point. However, gas turbine operations require a much broader range of inlet temperatures and fuel-air ratios. In a typical situation, the fuel-air ratio limits are approximately 0.005-0.025 and the inlet temperature ranges from ambient at ignition to about 600° F. on the simple cycle machines. Catalyst ignition does not readily occur, however, at inlet temperatures which are less than about 1000° F. for most catalysts. In order to overcome this problem, the most common solution is to employ a pilot burner for ignition and acceleration and by waiting until the machinery is under part load to initiate catalytic burning.

The conventional catalytic gas turbine combustor generally employs a pilot zone disposed upstream of the catalyst. This arrangement has two principal disadvantages. First, the catalyst bed is subjected to thermal shock when the pilot zone is ignited. Secondly, when the catalytic operation is initiated, the pilot burner must be extinguished. One method of extinguishing the pilot burner is to interrupt the fuel flow to the pilot. An alternative method is to reduce the fuel supply to the pilot zone while adding fuel to the catalytic main stage. In these arrangements, the fuel air and combustion products from the pilot zone mix and enter the catalytic section of the combustor where the fuel burns. In these instances, there is a danger that autoignition will occur upstream of the combustor which will thermally shock the combustor, increase the pressure drop and unbalance the chamber to chamber mass flow and require that the system be shut down or revert to pilot operation only. Another disadvantage of this type of system is that the face velocity is higher when the pilot zone is fired since the temperature is elevated upstream of the catalyst bed.

The conventional catalytic gas turbine combustors are generally known as fuel staged combustors because they require two separate fuel control systems which can be either active or passive. The operating range of the catalytic reactor can also be extended by adding air staging, commonly called variable geometry in the art. In an air staged system, less air is introduced upstream of the catalyst when the combustor fuel flow requirement is low, i.e., the combustor air flow distribution is varied so as to maintain the catalyst fuel-air ratio within a narrow range. While variable geometry combustors offer a number of theoretical advantages, they are generally impractical because of the enormous hardware complexity required.

One system which has been proposed to burn any unspent fuel in the catalyst bed effluent is to provide a secondary thermal combustion chamber downstream of the catalyst bed. One such arrangement is described in Flannigan, U.S. Pat. No. 4,047,877 in which a thermal burner which is disposed for directing jets of burning gaseous fuel such as natural gas from a multiplicity of points just downstream of the catalyst is described. A fuel-air mixture is ignited in a pilot zone during start-up and passed through the catalyst zone into the secondary combustion chamber. The secondary chamber then burns any unspent fuel in the catalyst bed effluent.

It is accordingly the object of this invention to provide a new catalytic combustor and method of operation which maintains the desirable features of catalytic combustors, particularly low NOx emissions, while accomplishing gas turbine ignition and acceleration without the use of catalytic combustion and without combustion upstream of the catalytic combustor thereby decreasing the potential for imposing a thermal shock on the catalyst bed. This and other objects of the invention will become apparent to those skilled in this art from the following detailed description in which the sole FIGURE is a schematic representation of a catalytic combustor constructed in accordance with the invention.

SUMMARY OF THE INVENTION

This invention relates to a catalytic combustor and the method for its operation. More particularly, the catalytic combustor contains a pilot zone having means to introduce fuel therein, upstream of the pilot zone and in communication therewith, a catalytically supported thermal combustion zone which comprises a plurality of catalytically supported thermal combustion sections each comprising a solid oxidation catalyst, means for introducing air and means for introducing fuel; and fuel staging means. The fuel staging means are employed in order to regulate the degree of combustion occurring in either the pilot or the catalytically supported thermal combustion zone under all given load conditions to minimize NOx emissions.

BRIEF DESCRIPTION OF THE DRAWING

The drawing is a side view, partly in section, of a catalytic combustion system according to an embodiment of the invention.

DESCRIPTION OF THE INVENTION

The catalytic combustor of the present invention is a lean burning fuel staged catalytic combustor with a downstream pilot burner. The combustor of the present invention has the advantage that gas turbine ignition and acceleration can be accomplished without the use of catalytic combustion and without combustion upstream of the catalytic reactor thereby decreasing the potential for imposing a thermal shock on the catalyst. The only temperature rise experienced by the catalyst bed during acceleration is a slow steady increase which is approximately equal to the rise in the compressor discharge temperature. Catalytic ignition can be effected under load so that the associated slow change in heat release rate of about 10–30 seconds is buffered by the generator. The catalytic combustor also has the advantage that a minimum fuel flow can be used to maintain a flame downstream of the catalyst which, while resulting in somewhat higher NOx emissions, will ignite unburned or partially burned fuel exiting the downstream end of the catalyst modules. Additionally, the heat transfer from the downstream flame may be sufficient for catalyst ignition when initiating catalytic burning but other alternate or supplemental methods for catalytic ignition can also be used. Further, in the event of mechanical failure of the reactor, fuel will substantially burn in the pilot zone rather than in the power turbine.

The catalytic combustor of the present invention also has the advantage that the control sequence for fuel staging is simple and can readily be a passive system because the fuel introduced into the catalytic main stage will be burned in the pilot zone even if the reaction is incomplete in the catalyst bed. Accordingly, automatic valves in the main stage fuel lines are sufficient to provide adequate control even in a modular system.

The sole FIGURE is a schematic representation of a catalytic combustor in accordance with the principles of the present invention. The combustor contains a pilot zone 1 into which liquid or gaseous fuel from any suitable source is introduced through a supply conduit 2 and fuel nozzle 3. The combustor also contains a catalytically supported thermal combustion zone which, in the particular arrangement illustrated, is composed of three concentric ring sections 5, 6 and 7 surrounding the pilot zone conduit 2 and fuel nozzle 3. It will be appreciated that the number of catalytically supported thermal combustion sections and the individual configuration of each section is not limited and can be varied as desired.

Each of sections 5, 6 and 7 contains a catalyst 8, 9 and 10, each of which is maintained separate from the catalyst in another section. Each section 5, 6 and 7 has its individual fuel supply line 11, 12, and 13 and individual means for supplying air such as lines 14, 15 and 16. Air for combustion can be supplied to pilot zone 1 by admixture with the pilot zone fuel introduced through conduit 2 and fuel nozzle 3, through zones 5, 6, and 7, or in any other conventional manner. The air flow to sections 5, 6 and 7 through supply means 14, 15 and 16 is fixed and need not be adjusted. Fuel flow to catalytic sections 5, 6 and 7 and also to pilot zone 1 is, on the other hand, scheduled, i.e., staged, by any suitable means such as the valves shown as 17, 18, 19 and 20. Alternatively, staging can be effected by other means such as the commercially available nozzles that begin to open at specified pressures and therefore do not need active control. Various arrangements of fuel injectors and air injectors such as shown, for example, in the DeCorso U.S. Pat. No. 3,938,326 can be adapted for use in the present catalytic combustor.

The catalysts used in the present invention are any of the solid oxidation catalysts known to be useful heretofore for the oxidation of fuels. The catalyst usually comprises a carrier and an active component with or without additional activators or promotors. The catalysts can include a wide variety of materials as well as configurations or structures and thus can be in the form of a packed bed of pellets, saddles, rings and the like. The catalyst is preferably a monolithic or unitary structure in which the carrier is a cylindrical ceramic material or thin-walled honeycomb structure impregnated with one or more catalytically active components. The catalyst is usually a noble metal or a base metal oxide of such elements as zirconium, vanadium, chromium, manganese, copper, platinum, palladium, iridium, rhodium, ruthenium, cerium, cobalt, nickel, iron and the like.

In operation, the combustor of the present invention is started up by metering liquid or gaseous fuel, preferably liquid fuel, through valve 20 into conduit 2 and fuel nozzle 3 into pilot zone 1. A suitable quantity of air is also introduced into pilot zone 1 which is ignited and combusted in the conventional manner. All or preferably part of the air flow is through catalytically supported thermal combustion sections 5, 6 and 7 and such air flow is maintained at a steady state throughout all operations of the combustor. The temperature in catalyst beds 8, 9 and 10 undergo a slow steady increase which is approximately equal to the temperature rise measured at the compressor discharge port. When the temperature in catalyst beds 8, 9 and 10 has reached a point where there can be sustained catalytic combustion, an appropriate amount of the fuel is metered through valves 17, 18 and 19 and introduced into sections 5, 6, 7, respectively. Ignition of the catalytically supported thermal combustion zone may be initiated by radiation from the combuston in pilot zone 1 if the fuel-air admixture and the temperature in the zone is sufficient to support instantaneous auto-ignition. Alternatively, combustion can be initiated by allowing a flame to propagate from pilot zone 1 through a small tube to the upstream face of the catalytic zone or, alternatively, by use of a small electrically heated flame holder just upstream of the combustor. Since combustion continues in pilot zone 1 during the catalytic combustion initiation, the slow change in the heat release rate which occurs over a time period of about 10 to 30 seconds is buffered. It will be appreciated that catalytic sections 5, 6 and 7 can be brought into operation simultaneously, sequentially or in any sequence desired.

Fuel staging is accomplished by suitable regulation of the fuel line valves 17, 18, 19 and 20. Although not essential, it is preferred to maintain a degree of combustion in pilot zone 1 at all times in order to smooth the effect of staging individual catalytic reactor modules 5, 6 and 7 and also to prevent extension of the combustion zone into the turbine upon mechanical failure of the catalytic reactor, and further to combust any unspent fuel exiting the catalytic zone. It is to be expected that the emissions of nitric oxides will be higher at part load when the catalytic zone is not in operation than at full load because a greater amount of NOx is generated in the pilot flame. However, by appropriate control of the fuel-air ratios and fuel staging, the amount of NOx emissions from the combustor is minimized under all given load conditions.

In a preferred operation under full load, about 67% of the air flow to the combustor and about 76% of the fuel flow is to the catalytic zone thereby providing a fuel-air ratio of about 0.027 and a catalyst bed temperature of about 2400° F. About 12% of the air and the remaining fuel, (about 24%) are conveyed to the pilot zone 1 so that the fuel-air ratio in the vicinity of fuel nozzle 3 is about 0.047 which is sufficiently high to create a well stabilized flame zone. The remaining 21% of the air flow is divided almost equally between cooling the combustor wall downstream of the pilot zone 1 (11%) and shaping the profile of the effluent gas temperature at the combustor exit by means of dilution (10%).

In a preferred form of the instant combustor, the fuel and air introduced into catalytic sections 5, 6, and 7 are premixed in a suitable premix chamber 21, 22, and 23 which can, if desired, be provided with means for heating the mixture. No combustion is effected in premix chambers 21, 22 and 23.

Various changes and modifications can be made in the combustor of the present invention and its operation without departing from the spirit and scope thereof. The various embodiments disclosed herein were for the purpose of further illustrating the invention but were not intended to limit it.

What is claimed is:

1. A method for operating a combustor of a gas turbine, said combustor being of the type having a catalytic combustion zone including a plurality of independent catalytically supported combustion sections, a single pilot zone downstream of said catalytic combustion zone, means for feeding a fuel to said single pilot zone, means for independently introducing fuel and air into said plurality of independent catalytically supported combustion sections and all of an effluent of said plurality of independent catalytically supported combustion sections entering said single pilot zone, comprising:

initially accelerating said gas turbine to a predetermined load condition using hot gases generated only in said single pilot zone by feeding said fuel to said single pilot zone and air into at least one of said plurality of independent catalytically supported combustion sections, said air passing downstream of said at least one of said plurality of independent catalytically supported combustion sections to be useable as combustion air with said fuel in said single pilot zone; and further accelerating said gas turbine to a greater load condition by staging fuel to individual ones of said plurality of independent catalytically supported combustion sections to produce additional hot gases which pass downstream of said plurality of catalytically supported combustion sections, an excess air in said additional hot gases being effective to support combustion of said fuel fed to said single pilot zone and combustion in said single pilot zone being effective to clean up unburned portions of fuel entering said single pilot zone with said hot gases from said plurality of catalytically supported combustion sections; and at least partially preheating a catalyst in said catalytically supported combustion sections toward an operating temperature during the step of initially accelerating said gas turbine.

2. A method according to claim 1 further comprising premixing said fuel to individual ones of said catalytically supported combustion sections before contacting a catalyst in said catalytically supported combustion sections.

3. A method according to claim 1 further comprising further heating said catalyst toward its operating temperature during the step of further accelerating said gas turbine and burning unburned fuel from said catalytically supported combustion sections in said single pilot zone during the step of further accelerating at least until said catalyst attains an operating temperature which is capable of enabling said catalyst to substantially completely combust said fuel fed to said catalytic combustion zone.

* * * * *